US006491197B1

(12) United States Patent
Walker

(10) Patent No.: US 6,491,197 B1
(45) Date of Patent: Dec. 10, 2002

(54) GOLF BAG BALANCING ATTACHMENT AND METHOD

(76) Inventor: John Walker, 315 N. Jefferson Ave., Indianapolis, IN (US) 46254

( * ) Notice: Subject to any disclaimer, the term of this patent is extended or adjusted under 35 U.S.C. 154(b) by 0 days.

(21) Appl. No.: 09/888,019

(22) Filed: Jun. 25, 2001

(51) Int. Cl.[7] ..... A45F 3/02

(52) U.S. Cl. ..... 224/613; 206/315.3; 224/616

(58) Field of Search ..... 206/315.3, 315.4, 206/315.5, 315.6, 315.7, 315.8; 224/620, 613, 614, 615, 616

(56) References Cited

U.S. PATENT DOCUMENTS 1,838,699 A * 12/1931 McMonies et al. ..... 206/315.6
1,845,088 A * 2/1932 Hunerhoff ..... 190/903
1,954,413 A * 4/1934 Hunter ..... 206/315.7
2,364,223 A * 12/1944 Keim ..... 206/315.3
2,711,201 A * 6/1955 Hotze ..... 206/315.5
4,332,283 A * 6/1982 Rader ..... 206/315.6
4,911,347 A * 3/1990 Wilhite ..... 224/251
5,176,253 A * 1/1993 Perrin et al. ..... 206/315.3
5,222,598 A * 6/1993 Yamazoe ..... 206/315.5
5,348,205 A * 9/1994 Steurer ..... 206/315.3
5,499,761 A * 3/1996 Reimers ..... 206/315.3
6,036,009 A * 3/2000 Kim ..... 206/315.3
6,325,208 B1 * 12/2001 Cheng ..... 206/315.7

* cited by examiner

*Primary Examiner*—Stephen P. Garbe
(74) *Attorney, Agent, or Firm*—Daniel J. O'Connor

(57) ABSTRACT

An attachment for a golf bag which achieves a balancing of the bag when longer clubs are being carried. The attachment includes a belt element which is wrapped around the top of a golf bag. The belt includes an extension element which is positioned at the front, top side of a golf bag. The resulting installation creates a balanced golf bag effect and thus takes pressure off the back of the golf bag carrier.

1 Claim, 2 Drawing Sheets

GOLF BAG BALANCING ATTACHMENT AND METHOD

BACKGROUND AND OBJECTS OF THE INVENTION

The present invention is generally related to the golfing arts and, in particular, to a novel design for use in combination with a golf bag.

When full of golf clubs, especially longer golf clubs used by taller people, the golf clubs tend to lean forward toward the mid-back of the person carrying the golf bag.

Such creates a continuing pressure on the mid-back of the person carrying the bag and, over the course of playing eighteen holes of golf, can become quite painful and damaging to the back of the user.

Accordingly, it is an object of the present invention to set forth a novel golf bag attachment design to reduce or eliminate to forwardly transmitted forces from a golf bag to the back of a person carrying a golf bag.

It is also an object of the invention to show a balancing golf bag attachment which may be easily used and readily attached to the top of a golf bag.

It is a further object of the invention to demonstrate a golf bag attachment which may be economically manufactured for widespread commercial appeal and use.

These and other objects and advantages of the present invention will be apparent to those of skill in the art from the description and drawings which follow.

PRIOR ART PATENTS AND DESIGNS

During a search of the prior arts patents and commercial designs, the following U.S. Patents were found to be broadly related to the present invention.

U.S. Pat. No. 6,202,850 shows a cover placed on top of a golf club bag. Its purpose and structure are to provide protection for the heads of golf clubs. It does not provide the balancing or pressure relieving features disclosed in the present invention.

U.S. Pat. No. 6,036,009 was issued for a golf club bag which has structures adaptable for use with shorter or longer golf clubs. This patent also does not show or suggest the balancing and pressure relieving features of the present invention.

Accordingly, the invention disclosed herein is believed to be clearly novel and patentable over all known prior art designs.

SUMMARY OF THE INVENTION

A system is provided to balance a golf club bag in order to relieve pressure on the back of a person carrying the bag.

An extension is attached to an upper portion of the golf club bag so as to change the lift point to eliminate the tendency of the bag to lean forward.

In the embodiment disclosed, the extension is attached to the golf club bag by means of a belt which is adaptable for use with variably sized and shaped club bags.

The principles disclosed herein may have applicability with other types of balancing and carrying systems.

BRIEF DESCRIPTION OF THE DRAWING FIGURES

FULL DESCRIPTION OF A PREFERRED EMBODIMENT

Figure 1:
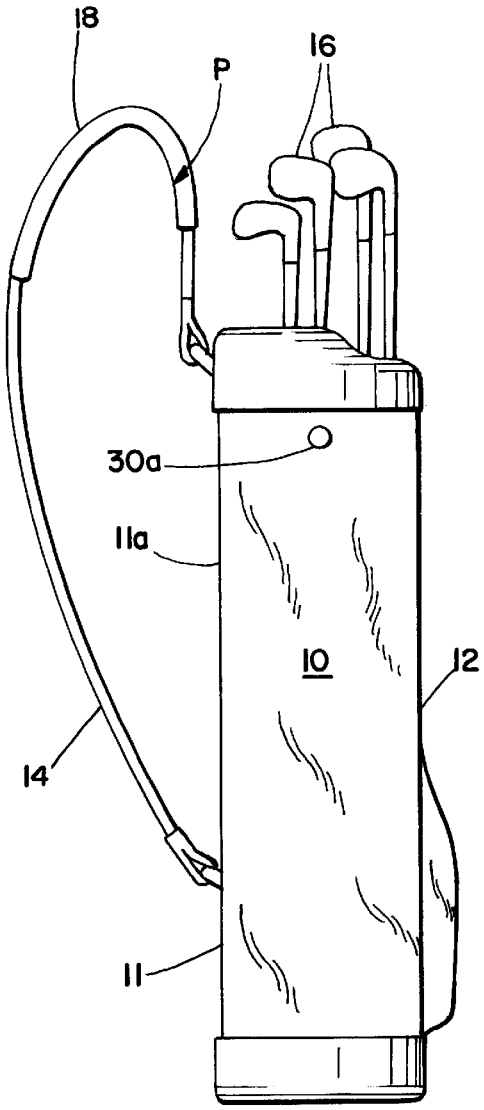
Fig. 1 (PRIOR ART)
FIG. 1 shows a conventional golf club bag and illustrates the pressure P which is inherent in such bags upon the back of a user.

Referring to the drawing FIG. 1, a conventional golf bag 10 is shown as having a forward portion 11 and a rearward portion 12. A strap 14 for carrying the bag 10 on the back-shoulder 18 of a user is also shown.

A set of golf clubs 16 carried within the golf bag are also shown.

As previously noted, the golf clubs 16, especially when longer clubs are used in a conventionally sized golf bag, tend to lean forward toward the back or shoulder 18 of the user.

Thus, a pressure P is created on the back of the golf bag carrier. Over eighteen holes of golf, such pressure P can create significant back pain and other discomfort for the user.

The conventional golf bag 10 shown in FIG. 1 may also have snaps 30*a* at the top thereof for attaching various items to be described.

FIG. 1 also shows an upper, forward portion of the golf club bag at numeral 11*a*.

Figure 2:
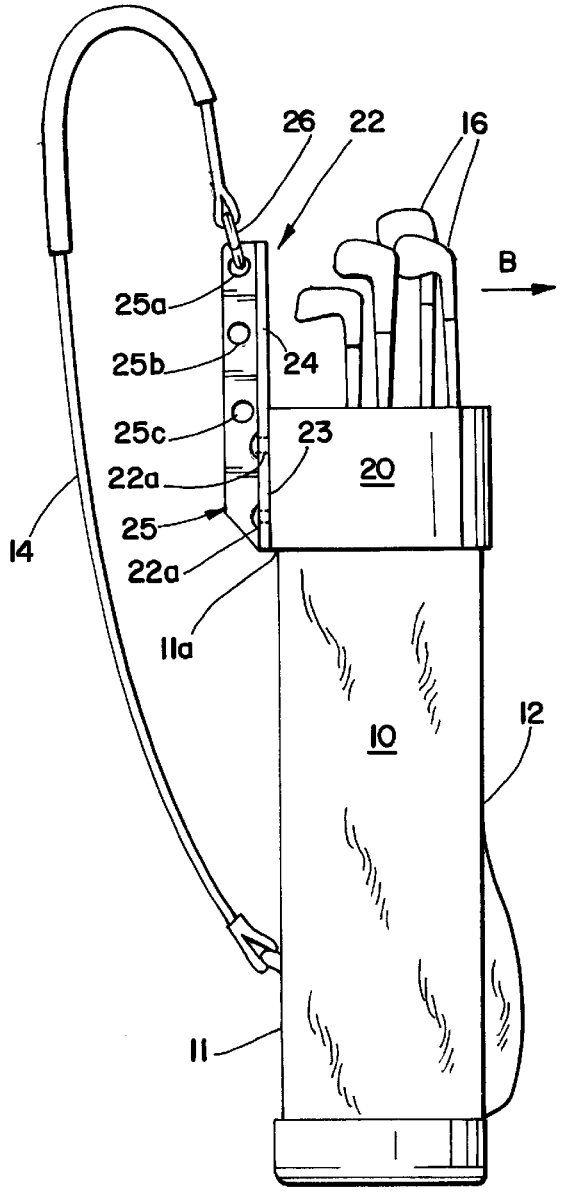
FIG. 2 shows the attached belt and extension element which has the beneficial effect of relieving pressure on the back of the golf club bag user.

FIG. 2 shows a belt 20 and attached extension element 22 which are placed around the bag 10 so that the extension element 22 is at the upper, forward position 11*a* of the golf club bag.

The extension element 22 includes a widened base plate 23 and a narrowed upper extension plate 24.

A ridge element 25 is attached in perpendicular fashion to the respective plates 23 and 24. The ridge 25 has plural apertures formed therein as indicated at numerals 25*a*, 25*b* and 25*c*.

As further shown in FIG. 2, a snap ring 26 is attached to the uppermost aperture 25*a* and also to the carrying strap 14.

In using the extension element, a higher lift point is thus created which results in a balancing force B to eliminate pressure on the user's back.

The higher lift point provided by aperture 25*a* means that the bag is balanced and easier to carry. That is, the user does not have to continually adjust the carried bag on his or her shoulder. Thus, pressure and back aggravation are relieved.

In FIG. 2, numerals 22*a* indicate screws which may be used to attach the extension element 22 to the belt 20.

Figure 3:
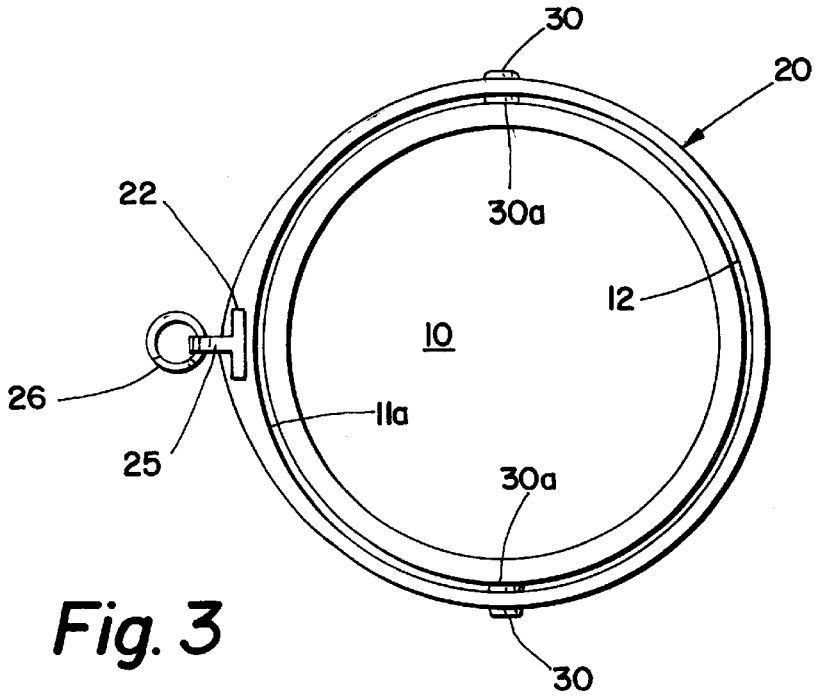
FIG. 3 is a top view of the golf club bag with the extension and belt attached thereto.

In the top view of FIG. 3, with the belt 20 wrapped around the top portion of the golf club bag, the extension plate 22, perpendicular ridge 25 and snap ring 26 are also schematically shown.

The belt 20 may also include snap elements 30 which attach to snap elements 30*a* on the top of bag 10 to insure that the belt 20 is held in its desired position.

Other attaching means equivalent to the snaps 30 and 30*a* may also be included in the overall system to be further described.

Figure 4:
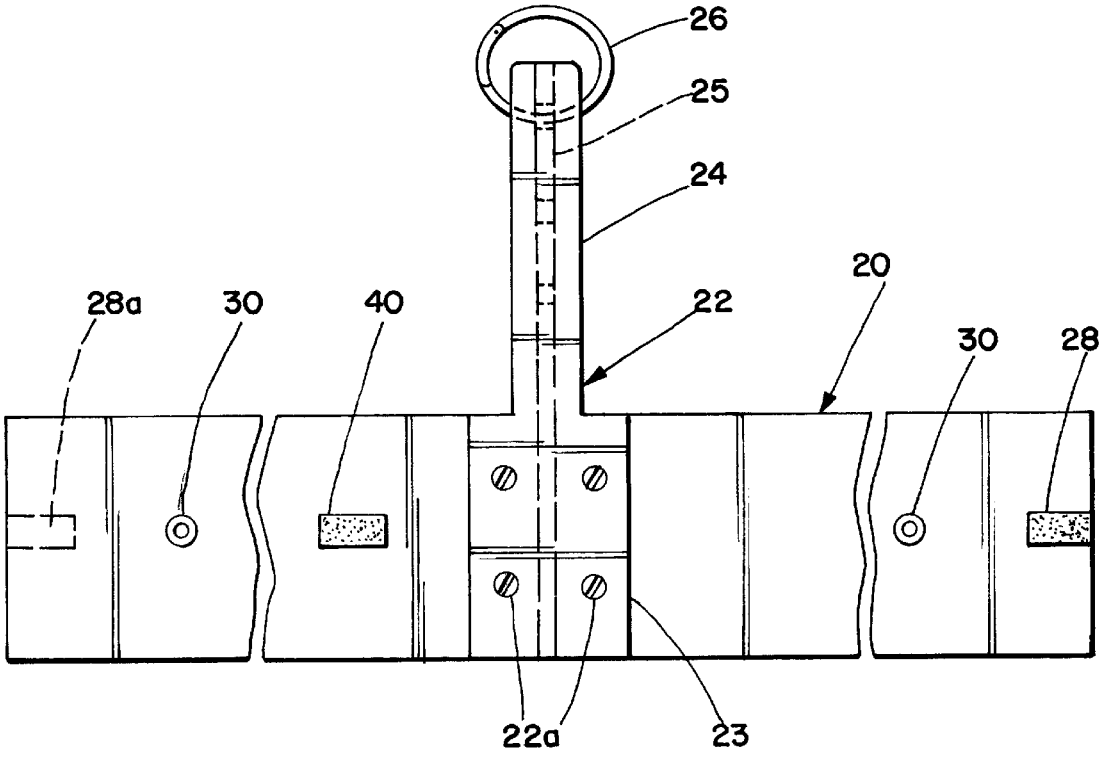
FIG. 4 is a top view of the belt and attached extension element with the belt being in an open or rolled-out position.

In FIG. 4, the belt is shown in its open or rolled-out position to further illustrate details of the invention. As shown, the extension element 22 includes a widened lower base plate 23 which is attached to the belt 20 via screws 22*a*.

A narrowed, upper extension plate 24 extends upwardly from the base plate 23.

Ridge 25, which is on the other side of the extension element 22 in FIG. 4, is indicated by the dashed lines shown.

The ends of belt 20 may further include Velcro fasteners as indicated schematically at 28 and 28*a* Snaps 30 are also indicated in FIG. 4. The belt 20 may further include Velcro® means 40 for use in attaching to the golf club bag 10 in the event that snaps are not available.

The lifting point on the ridge 25 may be varied by attaching the snap ring 26 to other apertures 25*b* and 25*c* positioned along the ridge 25. Thus, varied loads and/or club sizes can be carried in a balanced fashion.

Regarding the materials used in practice of the invention, it is contemplated that the belt would be formed of woven cloth, plastics or other durable and long-life materials. The extension element 22 could be comprised of metal, plastic or other suitable load-bearing materials.

While a particular design and method of use have been described and shown, it is intended in this specification to cover all equivalent designs and methods which would reasonably occur to those of skill in the mechanical arts.

The invention is further defined by the claims appended hereto.

I claim:

1. In combination with a golf club bag(10) having a forward side(11) and a rear side(12), wherein the forward side(11) has a carrying strap(14) attached thereto, an extension(22) attached to an upper portion(11*a*) of said forward side(11) for balancing the golf club bag, wherein one end of said strap(14) is attached to an aperture(25*a*) on said extension(22), wherein said extension(22) is mounted to a belt(20) via screws(22*a*) and wherein said belt extends around a top portion of said golf club bag(10), said belt having ends thereon, wherein said belt(20) includes fasteners(28,28*a*) which secure the ends of said belt together, wherein said belt includes snap elements(30,30*a*) which attach said belt to a top portion of said golf club bag, wherein said extension(22) comprises a widened lower base plate(23) and a narrowed upper extension plate (24), said extension further comprising a ridge element(25) in perpendicular relation to said plates(23,24), said ridge element(25) including at least one aperture (25*a*) for receiving a snap ring and retaining said strap(14).

* * * * *